US010508475B2

(12) United States Patent
Rosales et al.

(10) Patent No.: US 10,508,475 B2
(45) Date of Patent: Dec. 17, 2019

(54) MOTOR VEHICLE LOCK

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 0 days.

(21) Appl. No.: 13/950,033

(22) Filed: Jul. 24, 2013

(65) Prior Publication Data

US 2015/0028601 A1 Jan. 29, 2015

(51) Int. Cl.
*E05B 77/06* (2014.01)
*E05C 19/02* (2006.01)

(52) U.S. Cl.
CPC ..... *E05B 77/06* (2013.01); *E05C 19/02* (2013.01); *Y10T 292/0908* (2015.04)

(58) Field of Classification Search
CPC ..... E05B 77/02; E05B 77/04; E05B 77/06; E05C 19/02; Y10T 292/0908
USPC ..... 292/92, 194, 216, DIG. 22, DIG. 23, 292/DIG. 65
See application file for complete search history.

(56) References Cited

U.S. PATENT DOCUMENTS 3,799,596 A 3/1974 Nobuyuki et al.
4,382,622 A * 5/1983 Ishikawa ..... 292/216
4,995,654 A * 2/1991 Nishigami et al. ..... 292/216
5,865,481 A * 2/1999 Buschmann ..... 292/216
6,971,688 B2 * 12/2005 Drysdale et al. ..... 292/216
7,607,702 B2 10/2009 Pereverzev
8,303,004 B2 11/2012 Lee et al.
(Continued)

FOREIGN PATENT DOCUMENTS

DE 19511651 10/1995
DE 19738492 3/1998
(Continued)

OTHER PUBLICATIONS

European Search Report for corresponding application EP14161244.0, dated May 4, 2015 (4 pages).
(Continued)

*Primary Examiner* — Christine M Mills
(74) *Attorney, Agent, or Firm* — Pauly, DeVries Smith & Deffner LLC

(57) ABSTRACT

A lock can include a catch and a pawl. The catch can be brought into an opening position and a closed position. The catch can be brought into holding engagement with a lock striker. The pawl may be brought into a position, where it is in blocking engagement with the catch. The pawl may be deflected into a release position. A pawl actuation lever is provided. A switchable lock arrangement in an unlocked state can be included. A first drive train component is decoupled from the pawl for letting the pawl actuation lever run free without deflecting the pawl or a first drive train component is blocked for blocking an actuation of the pawl actuation lever. A crash condition causes the switchable lock arrangement to be in the locked state such that during the crash condition a crash induced actuation of the pawl actuation lever runs free or is blocked.

15 Claims, 5 Drawing Sheets

(56) References Cited

U.S. PATENT DOCUMENTS

| | | | | |
|---|---|---|---|---|
| 8,398,128 | B2 | 3/2013 | Long et al. | |
| 8,485,570 | B2 | 7/2013 | Konchan et al. | |
| 8,967,678 | B2 | 3/2015 | Rosales et al. | |
| 9,637,952 | B2 | 5/2017 | Wittelsbuerger et al. | |
| 2003/0234544 | A1* | 12/2003 | Jankowski et al. | 292/220 |
| 2009/0322105 | A1* | 12/2009 | Lee et al. | 292/237 |
| 2010/0283268 | A1* | 11/2010 | Cumbo | 292/196 |
| 2011/0181052 | A1 | 7/2011 | Brose et al. | |
| 2012/0035295 | A1 | 2/2012 | Huang et al. | |
| 2012/0110920 | A1* | 5/2012 | Takagi et al. | 49/503 |
| 2012/0313384 | A1 | 12/2012 | Cumbo et al. | |
| 2013/0015670 | A1 | 1/2013 | Perkins et al. | |
| 2014/0035295 | A1 | 2/2014 | Bendel et al. | |
| 2014/0132008 | A1 | 5/2014 | Bendel et al. | |
| 2014/0284941 | A1 | 9/2014 | Wittelsbuerger et al. | |
| 2014/0312630 | A1 | 10/2014 | Bendel et al. | |

FOREIGN PATENT DOCUMENTS

| | | | |
|---|---|---|---|
| DE | 202009009061 | | 1/2011 |
| FR | 2970680 | | 7/2012 |
| WO | WO 2012107024 | A2 * | 8/2012 |

OTHER PUBLICATIONS

Non-Final Office Action for U.S. Appl. No. 13/929,205, dated Jul. 13, 2015 (9 pages).

Final Office Action for U.S. Appl. No. 13/929,205, dated Apr. 1, 2016 (14 pages).

Non-Final Office Action for U.S. Appl. No. 13/929,205, dated Apr. 14, 2016 (15 pages).

Amendment and Response to Non-Final Office Action dated Apr. 14, 2016, for U.S. Appl. No. 14/136,759, submitted via EFS-Web on Sep. 14, 2016, 13 pages.

Amendment and Response to Final Office Action dated Apr. 1, 2016 for U.S. Appl. No. 13/929,205, submitted via EFS-Web on Oct. 3, 2016, 8 pages.

Amendment and Response to Non-Final Office Action dated Jul. 13, 2015, for U.S. Appl. No. 13/929,205, submitted via EFS-Web on Jan. 13, 2016, 11 pages.

Notice of Allowance for U.S. Appl. No. 13/929,205 dated Jan. 17, 2017 (7 pages).

* cited by examiner

MOTOR VEHICLE LOCK

FIELD OF THE INVENTION

The invention is directed to a motor vehicle lock for a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The crash safety plays an important role for today's motor vehicle locks. It is of particular importance that neither crash induced acceleration nor crash induced deformation leads to an unintended opening of the motor vehicle door which the motor vehicle lock is assigned to. For example, in case of a side impact on the motor vehicle the outer door handle may be reluctant to follow the impact due to mass inertia of the outer door handle. As a result a relative movement between the outer door handle and the motor vehicle door occurs, which again may lead to an unintended opening of the motor vehicle door. Alternatively or in addition a crash induced deformation may act on the motor vehicle lock, which may again lead to an unintended opening of the motor vehicle door. The motor vehicle lock should be robust against all those crash conditions that may lead to an unintended opening of the motor vehicle door.

The known motor vehicle lock (US 2011/0181052 A1), which is the starting point for the invention, is provided with the usual locking elements catch and pawl, wherein the pawl may be deflected into a release position by actuation of a pawl actuation lever.

For deflecting the pawl into its release position, a pawl actuation lever is provided which, together with the pawl, establishes an actuation drive train for deflecting the pawl.

The motor vehicle lock comprises a switchable lock arrangement, which is located in the actuation drive train. Being in a locked state, the switchable lock arrangement blocks a drive train component, namely the pawl actuation lever. Being in an unlocked state, the switchable lock arrangement allows deflecting the pawl by an actuation of the pawl actuation lever.

To guarantee a high crash safety the switchable lock arrangement switches into the lock condition, when a predetermined crash induced acceleration occurs. As a result, during a crash, the switchable lock arrangement locks further actuation of the pawl actuation lever.

The known motor vehicle lock guarantees a high crash safety with respect to predetermined crash induced acceleration. However, during the blockage of the pawl actuation lever, a crash induced deflection of the pawl is still possible, for example due to crash induced deformation.

It is the object of the invention to improve the known motor vehicle lock such that the crash safety is increased with low constructional effort.

SUMMARY

The above noted object is solved for a motor vehicle lock.

The proposed solution is based on the idea that the switchable lock arrangement, in its locked state, acts on two drive train components, which are located offset from one another in the actuation drive train.

According to the invention, the switchable lock arrangement being in a locked state, decouples a first drive train component from the pawl for letting an actuation of the pawl actuation lever run free without deflecting the pawl or blocks a first drive train component for blocking an actuation of the pawl actuation lever.

In addition to decoupling or blocking of the first drive train component, the switchable lock arrangement, in the locked state, is blocking a second drive train component for blocking its driving motion, which second drive train component is located in the actuation drive train offset from the first drive train component towards the pawl.

This additional measure further reduces the risk of the pawl being deflected by any drive train component which is situated between the pawl and the second drive train component.

Several embodiments lead to simple construction of the switchable lock arrangement. An embodiment, proposes a close coupling and even a combination of the coupling element and the blocking element. With this approach, various existing motor vehicle locks may be provided with the proposed solution without structural changes.

In an embodiment, the proposed motor vehicle lock may be configured such that during very fast actuation of the pawl actuation lever the switchable lock arrangement does not reach its locked state quick enough in order to deflect the pawl into its release position. This is very useful in a crash situation as crash accelerations often lead to very fast actuation of the pawl actuation lever. As the delay of the switchable lock arrangement reaching its locked state mainly goes back on mass inertia, this delay may easily be configured by choosing a corresponding weight distribution.

In an embodiment, the invention provides a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein the pawl may be deflected into at least one release position, in which it releases the catch, wherein a pawl actuation lever is provided, which is coupled to the pawl establishing an actuation drive train for deflecting the pawl into a release position in a driving motion of the actuation drive train components, wherein a switchable lock arrangement is located in the actuation drive train, wherein, with the switchable lock arrangement being in an unlocked state, an actuation of the pawl actuation lever deflects the pawl and, with the switchable lock arrangement being in a locked state, a first drive train component is decoupled from the pawl for letting an actuation of the pawl actuation lever run free without deflecting the pawl or a first drive train component is blocked for blocking an actuation of the pawl actuation lever, wherein a predetermined crash condition causes the switchable lock arrangement to be in the locked state such that during the crash condition a crash induced actuation of the pawl actuation lever runs free or is blocked, wherein in the locked state, in addition to decoupling or blocking of the first drive train component, the switchable lock arrangement is blocking a second drive train component for blocking its driving motion, which second drive train component is located in the actuation drive train offset from the first drive train component towards the pawl.

In an embodiment, the predetermined crash condition is one of a predetermined crash acceleration acting on the motor vehicle lock, a predetermined crash velocity acting on the motor vehicle lock and a predetermined crash deformation acting on the motor vehicle lock.

In an embodiment, the first drive train component is the pawl actuation lever.

In an embodiment, the second drive train component is a pawl release lever coupled to the pawl.

In an embodiment, the pawl is deflectable while the pawl release lever is being blocked by the switchable lock arrangement.

In an embodiment, the second drive train component is the pawl.

In an embodiment, the switchable lock arrangement comprises a moveable blocking element, which, in the locked state of the switchable lock arrangement, is in a blocking position, in which it is in or may come into blocking engagement with a counter blocking element for blocking of the second drive train component, and which, in the unlocked state of the switchable lock arrangement, is in a non-blocking position, in which it releases the second drive train component.

In an embodiment, during the pawl actuation lever is running free due to the switchable lock arrangement being in its locked state, the blocking element is being hindered to move into its non-blocking position by a guide contour.

In an embodiment, the switchable lock arrangement comprises a first coupling lever on the side of the pawl actuation lever, a second coupling lever on the side of the pawl and a moveable coupling element that in the unlocked state is in a closing position for a coupling engagement with the two coupling levers and in the locked state is in an opening position for decoupling the two coupling levers.

In an embodiment, the coupling element and the blocking element are coupled to each other, such that moving the coupling element into the opening position goes along with moving the blocking element into the blocking position and moving the coupling element into the closing position goes along with moving the blocking element into the non-blocking position.

In an embodiment, the first coupling lever is the pawl actuation lever and that the second coupling lever is one of a pawl release lever coupled to the pawl and the pawl.

In an embodiment, the switchable lock arrangement is pretensioned into the unlocked state.

In an embodiment, deflecting the pawl actuation lever from its non-actuated state into its actuated state in normal operation causes movement of the switchable lock arrangement into the unlocked state and that deflecting the pawl actuation lever from its actuated state into its non-actuated state causes movement of the switchable lock arrangement into the locked state.

In an embodiment, deflecting the pawl actuation lever from its non-actuated state into its actuated state with a rapidity that is above a threshold rapidity, in particular induced by a crash, the pawl actuation lever runs free due to the mass inertia based delay in unlocking of the switchable lock arrangement.

In an embodiment, the pawl release lever comprises an engagement surface, which during a driving motion of the pawl release lever comes into driving engagement with a counter engagement surface on the pawl.

In an embodiment, the counter blocking element is fixed at the motor vehicle lock.

In an embodiment, the guide contour is arranged on the pawl actuation lever.

In an embodiment, the coupling element and the blocking element are fixedly coupled to each other.

In an embodiment, the coupling element and the blocking element are combined in a one piece component.

BRIEF DESCRIPTION OF THE FIGURES

In the following the invention will be described in an example referring to the drawings. In the drawings show

DETAILED DESCRIPTION

Figure 1:
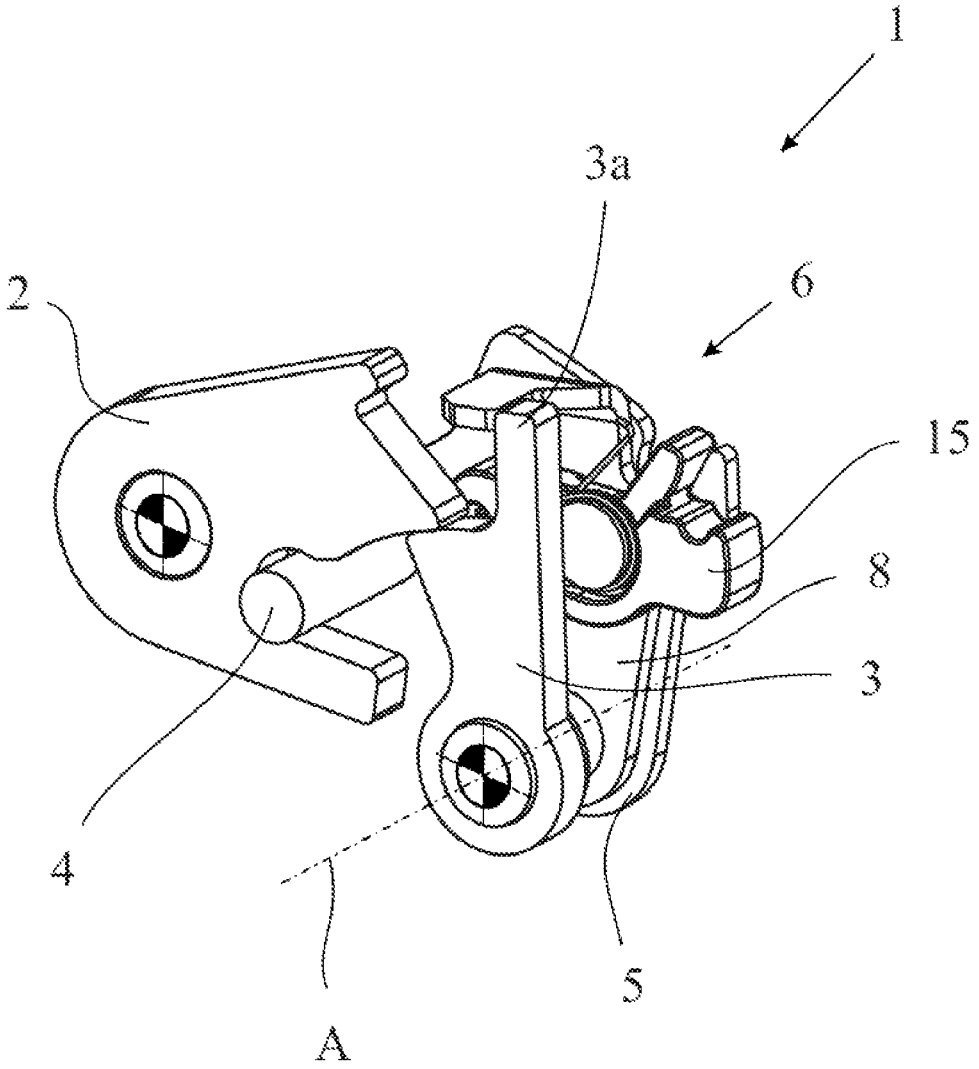
FIG. 1 shows selected parts of a proposed motor vehicle lock in a perspective view basically from the front side.

The motor vehicle lock 1 shown in the drawings is assigned to a motor vehicle door arrangement, which comprises a motor vehicle door (not shown) besides said motor vehicle lock 1. Regarding the broad interpretation of the expression "motor vehicle door" reference is made to the background portion of the specification. In an embodiment, the motor vehicle door is a side door of the motor vehicle.

The motor vehicle lock comprises the usual locking elements catch 2 and pawl 3, which is assigned to the catch 2. The catch 2 can be brought into an open position (not shown) and into a closed position (FIG. 1). In the closed position shown in FIG. 1 the catch 2 is or may be brought into holding engagement with a lock striker 4 that is indicated in FIG. 1 as well. The motor vehicle lock 1 is normally arranged at or in the motor vehicle door, while the lock striker 4 is arranged at the motor vehicle body.

The pawl 3 may be brought into an engagement position shown in FIG. 1, in which it is in blocking engagement with the catch 2. The pawl 3 blocks the catch 2 in its closed position in a mechanically stable manner such that the pawl 3 itself does not have to be blocked. For release of the catch 2 into its open position the pawl 3 may be deflected into a release position (not shown), which would be a deflection in the clockwise direction in FIG. 1.

Figure 2:
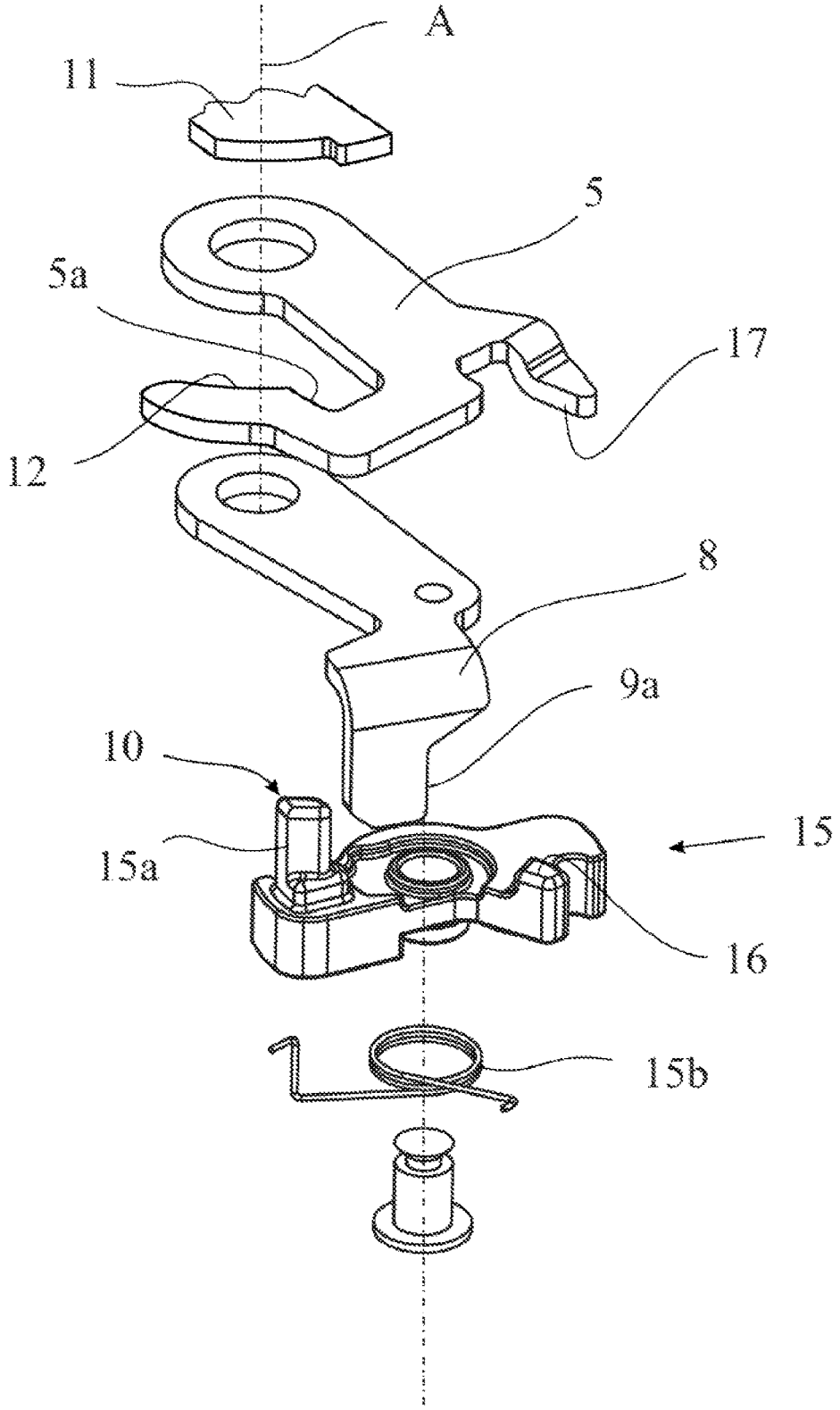
FIG. 2 shows the switchable coupling arrangement of the motor vehicle lock according to FIG. 1 in an exploded view.
Figure 3:
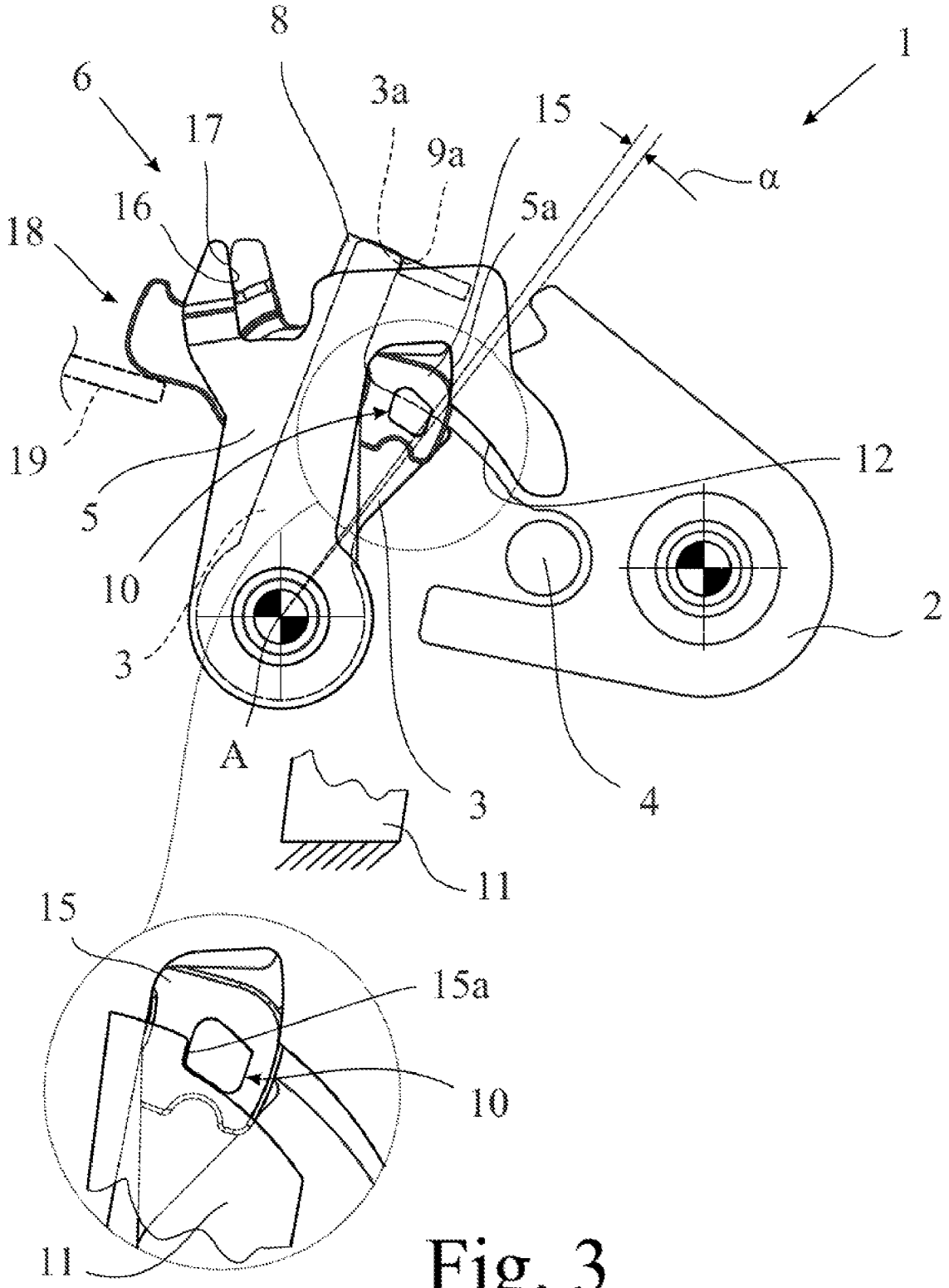
FIG. 3 shows the motor vehicle lock according to FIG. 1 in a backside view with non-actuated pawl actuation lever.

FIGS. 2 and 3 in combination show that a pawl actuation lever 5 is provided for deflecting the pawl 3 into the release position. The pawl actuation lever 5 may be coupled to a door handle, such as an outer door handle, such that the assigned motor vehicle door may be opened by actuating the door handle.

As will be explained in further detail, the pawl actuation lever 5 is coupled to the pawl 3 establishing an actuation drive train for deflecting the pawl 3 into the release position in a driving motion of the actuation drive train components. Accordingly, such drive train components, for example, are the pawl actuation lever 5 and the pawl 3 itself.

Figure 4:
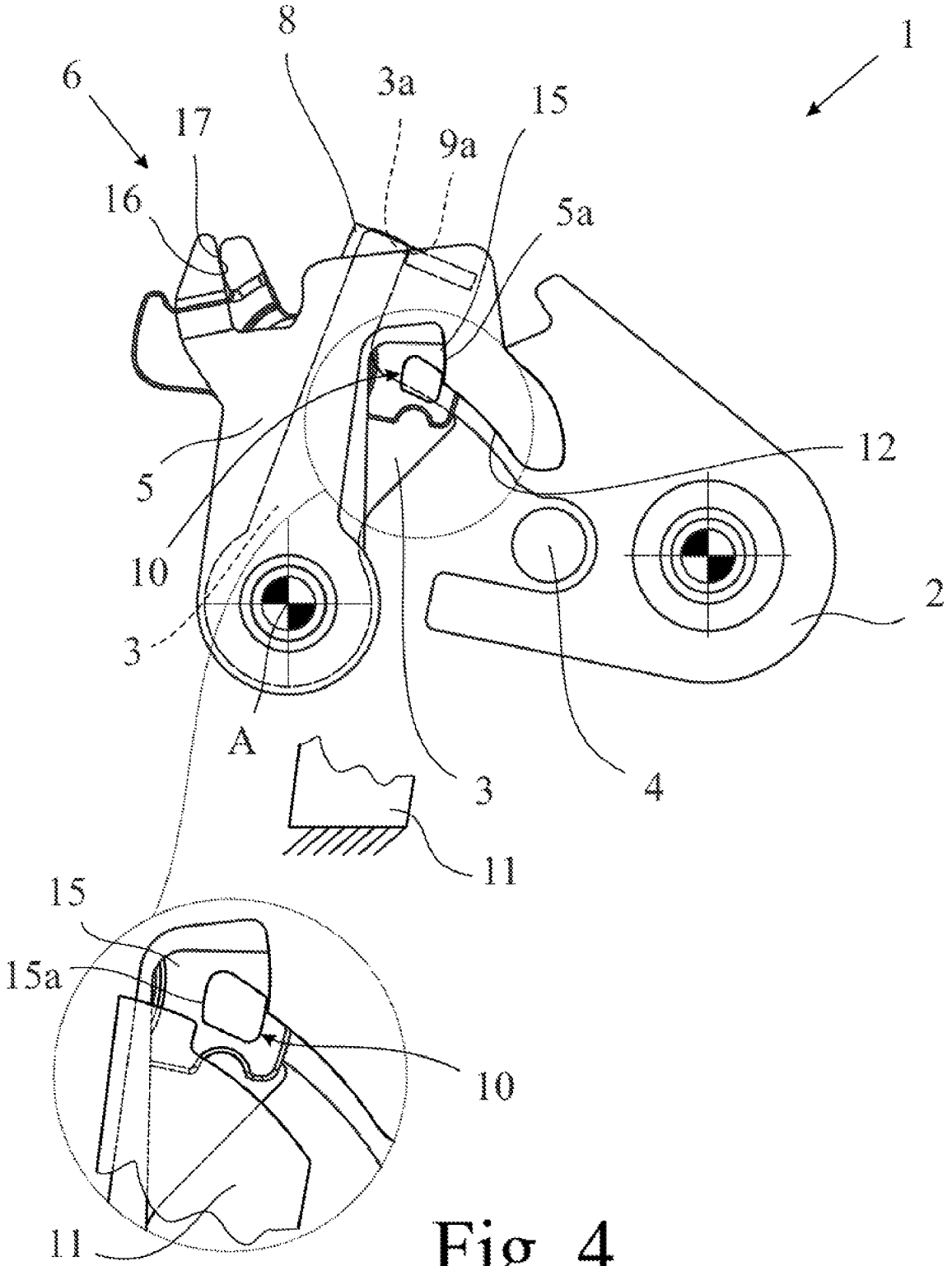
FIG. 4 shows the motor vehicle lock according to FIG. 1 in a backside view during actuation of the pawl actuation lever in normal operation and FIG. 5 shows the motor vehicle lock according to FIG. 1 in a backside view during actuation of the pawl actuation lever, which actuation is induced by a crash condition.
Figure 5:
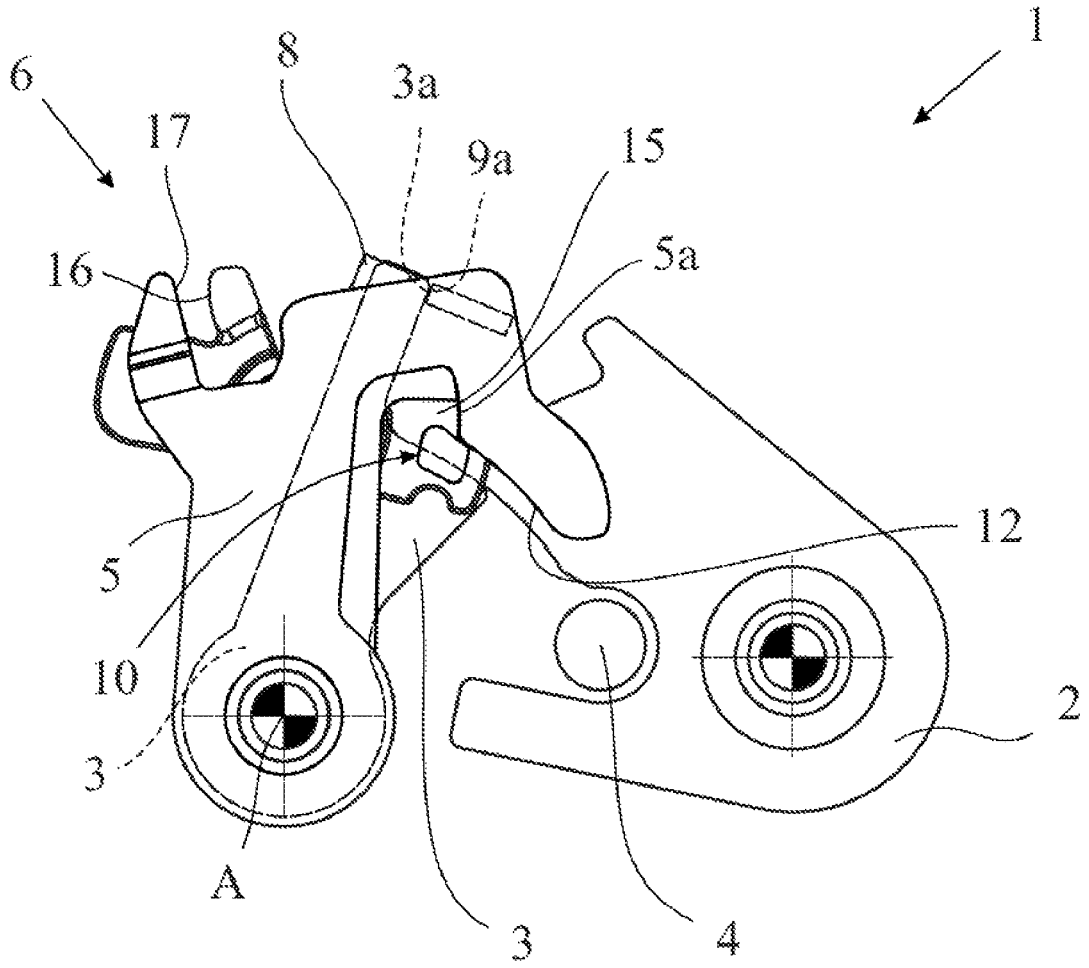

Again, FIGS. 2 and 3 in combination show that a switchable lock arrangement 6 is located in the actuation drive train. The switchable lock arrangement 6 is switchable into an unlocked state (FIG. 4) and into a locked state (FIG. 3, 5). With the switchable lock arrangement 6 being in the unlocked state, an actuation of the pawl actuation lever 5 deflects the pawl 3 as is shown in FIG. 4. With the switchable lock arrangement 6 being in the locked state, a first drive train component is decoupled from the pawl 3 for letting an actuation of the pawl actuation lever 5 run free without deflecting the pawl 3, as is shown in FIG. 5. Alternatively and not shown in the drawings, with the switchable lock arrangement 6 being in a locked state, a first drive train component is blocked for blocking an actuation of the pawl actuation lever 5. In both cases, with the switchable lock arrangement 6 in the locked state, it is not possible to deflect the pawl 3 into a release position by actuation of the pawl actuation lever 5.

The proposed motor vehicle lock 1 is designed such that a predetermined crash condition causes the switchable lock arrangement 6 to be in the locked state such that during the crash condition a crash induced actuation of the pawl actuation lever 5 runs free or is blocked, as noted above. Such a predetermined crash condition may be a crash induced speed, acceleration or deformation that exceeds a certain threshold. An example for switching the switchable lock arrangement 6 based on a predetermined crash condition will be described later.

It is of particular importance now that in the locked state, in addition to decoupling or blocking of the first drive train component, the switchable lock arrangement 6 is blocking a second drive train component 8 for blocking its drive motion, which second drive train component 8 is located in the actuation drive train offset from the first drive train component towards the pawl 3.

Here the first drive train component is the pawl actuation lever 5. Accordingly, switching the switchable lock arrangement 6 into the locked state leads to letting the pawl actuation lever 5 run free or blocking the pawl actuation lever 5.

Further, the second drive train component 8 is a pawl release lever coupled to the pawl 3. The pawl release lever comprises an engagement surface 9*a*, which is or may be brought into engagement with a counter engagement surface 3*a* at the pawl 3. Accordingly, pivoting the pawl release lever in clockwise direction in FIG. 1 leads to a corresponding pivoting of the pawl 3 in clockwise direction. As may be seen from FIG. 1 this connection between the pawl 3 and the pawl release lever is only provided in the release direction of the pawl 3 and, in the non-actuated state may even include a gap between the engagement surface 9*a* and the counter engagement surface 3*a*. Insofar the expression "coupled to the pawl" is to be understood in a broad sense.

The above noted blocking of the pawl release lever is advantageous in applications that require a closing motion of the catch 2, while the switchable lock arrangement 6 being in its locked state. For this closing movement of the catch 2 the pawl 3 has to be able to deflect at least slightly. However, if this freedom of movement for the pawl 3 is not necessary, it may be advantageous that the second drive train component 8 is the pawl 3 itself. The pawl 3 would most safely be secured against unintended deflection.

The switchable lock arrangement 6 comprises a movable blocking element 10, which, in the locked state of the switchable lock arrangement 6, is in a blocking position. This is shown in the detailed view of FIG. 3. In the blocking position the blocking element 10 is in or may come into blocking engagement with a counter blocking element 11 for blocking of the second drive component 8 and the pawl release lever. The counter blocking element 11 may be seen in the detailed view of FIG. 3 as well. Here it is to be understood that the counter blocking element 11 is only fully displayed in the detailed view, and not in the normal view in FIG. 3, in order to reduce complexity.

In the unlocked state of the switchable lock arrangement 6, which is shown in FIG. 4, the blocking element 10 is in a non-blocking position, in which it releases the second drive train component 8. This is shown in the detailed view in FIG. 4. Again, the counter blocking element 11 is not fully shown in the normal view in FIG. 4, to reduce complexity.

The counter blocking element 11 is fixed at the motor vehicle lock 1. This means that in the blocking position the blocking element 10 may not move to the left in FIG. 3 and in the non-blocking position the blocking element 10 may be moved to the left in FIG. 4.

In an embodiment the blocking element 10 may not be moved into its non-blocking position as long as the pawl actuation lever is running free due to the switchable lock arrangement 6 being in its locked state. Accordingly it is proposed that during the pawl actuation lever 5 is running free due to the switchable lock arrangement 6 being in its locked state, the blocking element 10 is being hindered to move into its non-blocking position by a guide contour 12, which guide contour 12 is arranged on the pawl actuation lever 5. The guide contour 12 can be aligned to a circle around the pivot axis A of the pawl actuation lever 5. The switchable lock arrangement 6 can be realized as a switchable coupling arrangement.

For this, it comprises a first coupling lever on the side of the pawl actuation lever 5, a second coupling lever on the side of the pawl 3 and a movable coupling element 15 that in the unlocked state is in a closing position for a coupling engagement with the two coupling levers (FIG. 4) and in the locked state is in an opening position for decoupling the two coupling levers (FIG. 3, 5). The first coupling lever is the pawl actuation lever 5, while the second coupling lever is the pawl release lever.

In the unlocked state (FIG. 4), the coupling element 15 is in coupling engagement with both of the coupling levers such that actuation of the first coupling lever, the pawl actuation lever 5, leads to the same actuation of the second coupling lever, and the pawl release lever. For this engagement the coupling element 15 comprises a coupling surface 15*a*, which interacts accordingly with a hook like coupling surface 5*a* at the pawl actuation lever 5.

The coupling element 15 is arranged on one of the two coupling levers. Releasing the pawl actuation lever 5 from its actuated state (FIG. 4) into its non-actuated state (FIG. 3) causes engagement of a control surface 16 of the coupling element 15 with a counter control surface 17, which can be located at the first coupling lever, namely the pawl actuation lever 5. The engagement of the control surface 16 with the counter control surface 17 is such that the coupling element 15 is forced into its opening position and with it the blocking element 10 into its blocking position (FIG. 3). That deflecting the pawl actuation lever 5 from its non-actuated state (FIG. 3) into its actuated state (FIG. 4) releases the coupling element 15 into its closing position and with it the blocking element 10 into its non-blocking position.

It may be taken from the detailed view in FIGS. 3 and 4 that the coupling element 15 and the blocking element 10 are coupled to each other, such that moving the coupling element 15 into the opening position goes along with moving the blocking element 10 into the blocking position and moving the coupling element 15 into the closing position goes along with moving the blocking the element 10 into the non-blocking position. The coupling element 15 and the blocking element 10 are even combined in a one piece component. For the case, that the coupling element 15 and the blocking element 10 are separate pieces, any connection between those elements 15, 10 is possible. There may be a gearing between the coupling element 15 and the blocking element 10. It may be also advantageous, that the coupling element 15 and the blocking element 10 are fixedly coupled to each other.

In the shown embodiment the first coupling lever of the switchable lock arrangement 6 is the pawl actuation lever 5 as noted above and the second coupling lever is one of the pawl release lever coupled to the pawl 3 and the pawl 3 itself.

The switchable lock arrangement 6 can be pretensioned into its closing state such that deflecting the pawl actuation lever 5 from its non-actuated state (FIG. 3) into its actuated state (FIG. 4) in normal operation causes closing of the switchable lock arrangement 6. In further detail, the coupling element 15 is pretensioned into the closing position, in FIG. 3-5 into an anti-clockwise direction, such that deflecting the pawl actuation lever 5 from its non-actuated state (FIG. 3) into its actuated state (FIG. 4) in normal operation causes closing of the switchable lock arrangement 6. The pretension of the coupling element 15 can be realized by a spring arrangement 15*b* shown in FIG. 2.

It may be seen in FIG. 3 that with the pawl actuation lever 5 being in the non-actuated state closing the switchable lock arrangement 6 is being blocked by the engagement of the control surface 16 and the counter control surface 17. In further detail, in the situation in FIG. 3, closing the switchable lock arrangement 6 would only be possible by turning the coupling element 15 in an anti-clockwise direction into the position somewhat as shown in FIG. 4. The pawl actuation lever 5 can be pretensioned into the non-actuated state, in the drawings in the clockwise direction, such that the transfer of the coupling element 15 into its closing position is blocked by the engagement of the control surface 16 and the counter control surface 17. In this respect, the configuration is such that the pretensioning of the pawl actuation lever 5 dominates the pretensioning of the coupling element 15.

FIG. 5 shows a situation in which the deflection of the pawl actuation lever 5 from its non-actuated state into its actuated state is being performed with a rapidity that is above a threshold rapidity, such as induced by a crash. Here the coupling element 15, after a first actuation of the pawl actuation lever 5, travels into the direction of the closing position, driven by its pretension. However, due to the mass inertia regarding the mass of the coupling element 15, this movement of the coupling element 15 is delayed in such a way that the pawl actuation lever 5 runs free. As a result the crash induced actuation of the pawl actuation lever 5 has not led to the deflection of the pawl 3 into its release position. In addition, the blocking element 10 stays in its blocking position, such that the pawl release lever is being blocked as noted above (the counter blocking element 11 is not shown in FIG. 5 to reduce complexity). The probability of crash induced deflection of the pawl 3 is considerably reduced by this blocking action.

According to the above the actuation of the pawl actuation lever 5 firstly comprises a release section of movement of the pawl actuation lever 5, during which the coupling element 15 is being released to move into its closing position. This first section of movement is indicated in FIG. 3 with the angle $\alpha$ (alpha).

The first section of movement is followed by a subsequent pawl deflecting section of movement of the pawl actuation lever 5, during which the pawl 3 is being deflected into its release position if the coupling element 15 has reached its closing position during the release section of movement.

Interesting is now the aspect that the pawl actuation lever 5, while in the pawl deflecting section of movement, prevents the coupling element 15, which may still be in its opening position, from reaching its closing position. For this the pawl actuation lever 5 comprises the guide contour 12, that does not allow the coupling element 15 with its coupling surface 15*a* to pass into the direction of the closing position.

The mass inertia based delay regarding closing of the switchable lock arrangement 6 goes back mainly on the weight distribution of the coupling element 15. Accordingly, the delay and the above noted threshold rapidity may be configured easily just by changing the weight distribution of the coupling element 15.

In a further embodiment a lock mechanism 18 is provided, which may be brought into different functional states such as "unlocked" and "locked" via a lock actuation arrangement 19 indicated in FIG. 3. Those functional states are useful during normal operation, in particular, when a door handle, which is connected to the pawl actuation lever 5, shall be enabled or disabled regarding deflecting of the pawl 3. The lock mechanism 18 with its lock actuation arrangement 19 acts on the switchable lock arrangement 6 for realizing the functional states "unlocked" and "locked" such that the switchable lock arrangement 6 closes in the functional state "unlocked" and opens in the functional state "locked".

It may be seen in FIG. 3 that to realize the functional state "locked" the lock actuation arrangement 19 has to hold the coupling element 15 in the position shown in FIG. 3 without interfering with the movement of the pawl actuation lever 5. For realizing the functional state "unlocked" the lock actuation arrangement 19 simply has to be removed from the position shown in FIG. 3. With this simple arrangement not only the above noted crash function, but also a locking/unlocking function may be realized.

Finally it may be pointed out that the proposed solution is not only applicable to a motor vehicle lock 1 that is actuated manually by actuating a door handle. In the case that the pawl actuation lever 5 is drivable by a motor drive, a crash induced actuation of the pawl actuation lever 5 with high rapidity accordingly leads to the pawl actuation lever 5 running free as noted above.

The invention claimed is:

1. A motor vehicle lock for a motor vehicle door arrangement, comprising a catch, a pawl, a pawl actuation lever, and a switchable lock arrangement, wherein the pawl is assigned to the catch, wherein the catch can be brought into an opening position and into a closed position, wherein the catch, which is in the closed position, is or may be brought into holding engagement with a lock striker, wherein the pawl may be brought into an engagement position, in which the pawl is in blocking engagement with the catch, wherein the pawl may be deflected into at least one release position, in which the pawl releases the catch, wherein the pawl actuation lever is coupled to the pawl establishing an actuation drive train for deflecting the pawl into the at least one release position in a driving motion of the actuation drive train components, wherein the switchable lock arrangement is located in the actuation drive train, the switchable lock arrangement comprising a first mechanism and a second mechanism, the switchable lock arrangement is configured to transition between a locked state and an unlocked state, wherein in the unlocked state, an actuation of the pawl actuation lever deflects the pawl, and wherein in the locked state, the pawl actuation lever is either decoupled from the pawl for letting an actuation of the pawl actuation lever run free without deflecting the pawl, or physically blocked to block an actuation of the pawl actuation lever, wherein a predetermined crash condition causes the switchable lock arrangement to be in the locked state such that during the crash condition a crash induced actuation of the pawl actuation lever runs free or is physically blocked, wherein in the locked state, in addition to decoupling or physically blocking the pawl actuation lever by the first mechanism of the switchable lock arrangement, the switchable lock arrangement physically blocks a driving motion of a second drive train component by the second mechanism of the switchable lock arrangement, wherein the second drive train component is located in the actuation drive train offset from the pawl actuation lever towards the pawl, wherein the second mechanism comprises a moveable blocking element, which, in the locked state of the switchable lock arrangement, is in a blocking position, in which the moveable blocking element is in or may come into direct blocking engagement with a counter blocking element for blocking of the second drive train component, and which, in the unlocked state of the switchable lock arrangement, is in a non-blocking position, in which the moveable blocking element releases the second drive train component, and wherein the second drive train component is blocked by the moveable blocking element and the second chive train component is a component within the force chain to physically transfer an actuating force to actuate the pawl from the pawl actuation lever.

2. The motor vehicle lock according to claim 1, wherein the predetermined crash condition is one of a predetermined crash acceleration acting on the motor vehicle lock, a predetermined crash velocity acting on the motor vehicle lock and a predetermined crash deformation acting on the motor vehicle lock.

3. The motor vehicle lock according to claim 1, wherein the second drive train component is a pawl release lever coupled to the pawl.

4. The motor vehicle lock according to claim 3, wherein the pawl release lever comprises an engagement surface, which during a driving motion of the pawl release lever comes into driving engagement with a counter engagement surface on the pawl.

5. The motor vehicle lock according to claim 1, wherein the pawl is deflectable while a pawl release lever is being blocked by the switchable lock arrangement.

6. The motor vehicle lock according to claim 1, wherein while the pawl actuation lever is running free due to the switchable lock arrangement being in the locked state, the moveable blocking element is being hindered to move into the non-blocking position by a guide contour.

7. The motor vehicle lock according to claim 6, wherein the guide contour is arranged on the pawl actuation lever.

8. The motor vehicle lock according to claim 1, wherein a coupling element and the moveable blocking element are coupled to each other, such that moving the coupling element into the opening position goes along with moving the moveable blocking element into the blocking position and moving the coupling element into the closing position goes along with moving the moveable blocking element into the non-blocking position.

9. The motor vehicle lock according to claim 8, wherein the coupling element and the moveable blocking element are fixedly coupled to each other.

10. The motor vehicle lock according to claim 9, wherein the coupling element and the moveable blocking element are combined in a one piece component.

11. The motor vehicle lock according to claim 1, wherein the switchable lock arrangement is pretensioned into the unlocked state.

12. The motor vehicle lock according to claim 1, wherein deflecting the pawl actuation lever from a non-actuated state into an actuated state in normal operation causes movement of the switchable lock arrangement into the unlocked state and that deflecting the pawl actuation lever from the actuated state into the non-actuated state causes movement of the switchable lock arrangement into the locked state.

13. The motor vehicle lock according to claim 1, wherein deflecting the pawl actuation lever from a non-actuated state into an actuated state with a rapidity that is above a threshold rapidity the pawl actuation lever runs free due to a mass inertia based delay in unlocking of the switchable lock arrangement.

14. The motor vehicle lock according to claim 13, wherein the rapidity that is above the threshold rapidity is induced by a crash.

15. The motor vehicle lock according to claim 1, wherein the counter blocking element is fixed at the motor vehicle lock.

* * * * *